US007685660B2

(12) United States Patent
Chinn

(10) Patent No.: US 7,685,660 B2
(45) Date of Patent: Mar. 30, 2010

(54) COT HEIGHT INDICATOR

(75) Inventor: Bob Chinn, Cumming, GA (US)

(73) Assignee: Ferno-Washington, Inc., Wilmington, OH (US)

( * ) Notice: Subject to any disclaimer, the term of this patent is extended or adjusted under 35 U.S.C. 154(b) by 567 days.

(21) Appl. No.: 11/409,731

(22) Filed: Apr. 24, 2006

(65) Prior Publication Data

US 2007/0245496 A1 Oct. 25, 2007

(51) Int. Cl.
*A61G 1/02* (2006.01)

(52) U.S. Cl. ..... 5/611; 5/658; 254/124; 254/126

(58) Field of Classification Search ..... 5/611, 5/11, 658, 660; 296/20; 108/147.13, 144.11; 254/122, 126, 124
See application file for complete search history.

(56) References Cited

U.S. PATENT DOCUMENTS 2,495,558 A * 1/1950 Walton ..... 33/452
2,958,873 A * 11/1960 Ferneau ..... 5/86.1
4,249,580 A * 2/1981 Budzyna ..... 139/450
5,365,622 A 11/1994 Schirmer
5,432,966 A 7/1995 Berta et al.
5,732,425 A * 3/1998 Leung ..... 5/611
5,740,884 A * 4/1998 DiMucci et al. ..... 182/141
5,983,425 A * 11/1999 DiMucci et al. ..... 5/611
6,360,389 B1 * 3/2002 Gallant et al. ..... 5/658
6,381,781 B1 5/2002 Bourgraf et al.
6,942,226 B2 9/2005 Walkingshaw
7,386,900 B2 * 6/2008 Lemire ..... 5/611

* cited by examiner

*Primary Examiner*—Jennifer H Gay
*Assistant Examiner*—Gilbert Y Lee
(74) *Attorney, Agent, or Firm*—Dinsmore & Shohl LLP

(57) ABSTRACT

A patient transport cot comprises a height adjustment component coupled to the patient transport cot and configured to raise or lower the cot to a plurality of heights. The patient transport cot further comprises a mechanical height indicator, which comprises at least one height setting, wherein each height setting corresponds to a target cot height. The mechanical height indicator further comprises a moving height marker configured to move with the cot as the cot is raised or lowered, wherein the cot is adjusted to the target cot height when the moving height marker is aligned with the height setting.

11 Claims, 5 Drawing Sheets

COT HEIGHT INDICATOR

FIELD OF THE INVENTION

This invention relates to ambulance cots, and more particularly, ambulance cots comprising height indicators that enable a user to adjust a cot to a specific desired level.

BACKGROUND OF THE INVENTION

Manual and electrically powered ambulance cots have greatly improved the loading and unloading as well as the transport of patients. Cots adjust to various heights to facilitate the loading and unloading of patients from hospital beds, ambulances, rescue helicopters, etc. However, this flexibility also creates problems, especially with cots having infinite adjustments within a height range. Operators often find it difficult to quickly adjust a cot repeatedly to a specific desired level, for example, a load height for an emergency vehicle or even a hospital bed. Accordingly, there is a continuing desire to provide ambulance cots and cot components, thereof, which provide greater control and ease of use for an ambulance cot operator.

SUMMARY OF THE INVENTION

In a first embodiment of the present invention, a patient transport cot is provided. The patient transport cot comprises a height adjustment component coupled to the patient transport cot and configured to raise or lower the cot to a plurality of heights. The patient transport cot further comprises a mechanical height indicator coupled to the patient transport cot and comprising at least one height setting, wherein each height setting corresponds to a target cot height. The mechanical height indicator further comprises a moving height marker configured to move with the cot as the cot is raised or lowered, wherein the cot is adjusted to the target cot height when the moving height marker is aligned with the height setting.

In a second embodiment of the present invention, a patient transport cot is provided. The patient transport cot comprises a height adjustment component coupled to the patient transport cot and configured to raise or lower the cot to a plurality of heights. The patient transport cot further comprises an electronic height indicator coupled to the patient transport cot and comprising at least one height sensor, wherein each height sensor represents a target cot height. The electronic height indicator further comprises at least one visual display component coupled to the sensor, wherein the height sensor is triggered when the cot is adjusted to the target cot height setting represented by the height sensor. The triggering of the height sensor actuates the visual display component.

In a third embodiment of the present invention, a method is provided for adjusting the height of a patient transport cot to a target height. The method comprises providing a patient transport cot, which comprises a height adjustment component coupled to the patient transport cot and is configured to raise or lower the cot to a plurality of heights. The patient transport cot further comprises a mechanical height indicator coupled to the patient transport cot. The mechanical height indicator comprises at least one height setting on the indicator strip corresponding to a cot height, and a moving height marker configured to move with the cot as the cot is raised or lowered. The method further comprises adjusting the height of the patient transport cot by raising or lowering the cot until the moving height marker is aligned with the height setting.

In a fourth embodiment of the present invention, a method for adjusting the height of a patient transport cot to a target height is provided. The method comprises providing a patient transport cot, which comprises a height adjustment component coupled to the patient transport cot and is configured to raise or lower the cot to a plurality of heights. The patient transport cot comprises an electronic height indicator coupled to the patient transport cot. The electronic height indicator comprises at least one height sensor, wherein each height sensor represents a target cot height. The electronic height indicator further comprises at least one visual display component coupled to the sensor. The method further comprises adjusting the height of the patient transport cot by raising or lowering the cot until the height sensor is triggered, thereby actuating the visual display component.

Additional features and advantages provided by the cot height indicators of the present invention will be more fully understood in view of the following detailed description.

BRIEF DESCRIPTION OF THE DRAWINGS

The following detailed description of the embodiments of the present invention can be best understood when read in conjunction with the following drawings, where like structure is indicated with like reference numerals and in which.

DETAILED DESCRIPTION

Figure 1:
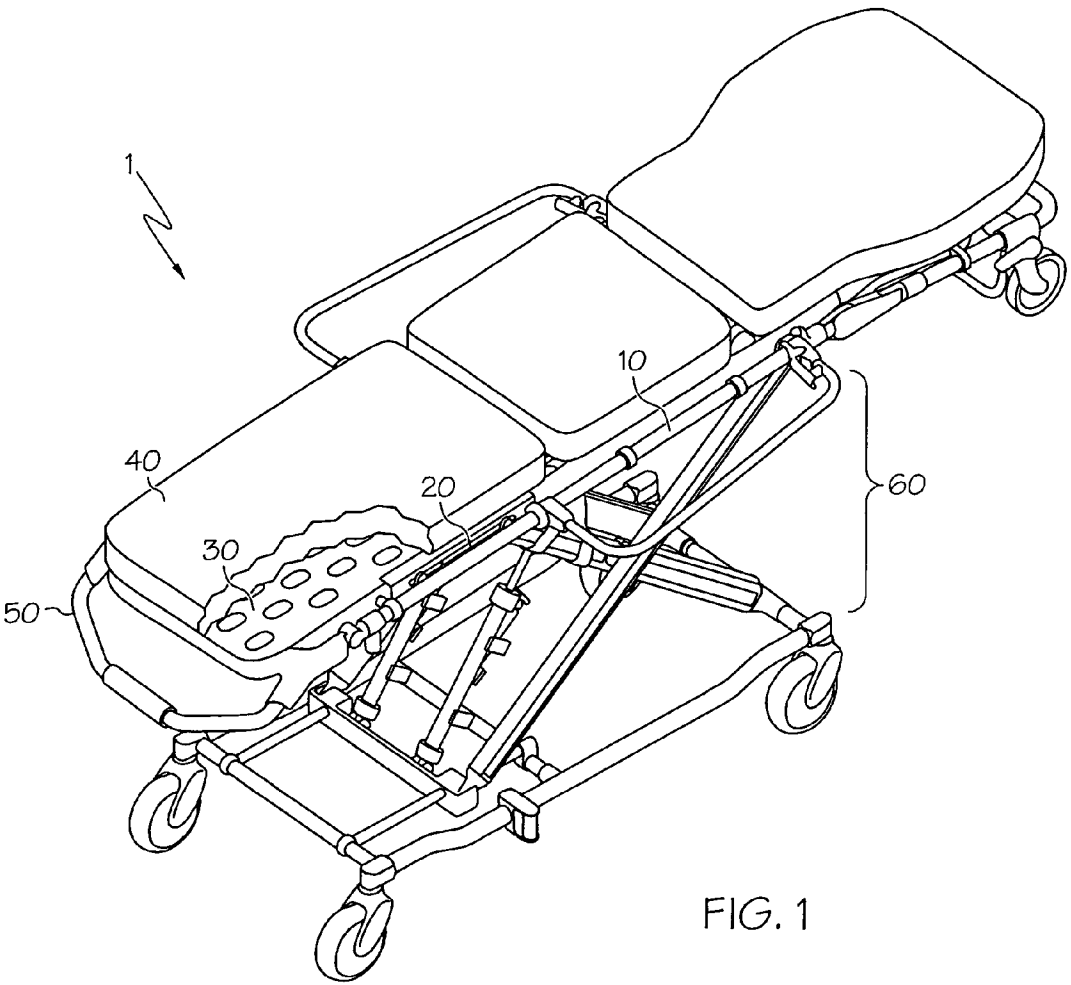
FIG. 1 is a schematic view of an ambulance cot comprising a mechanical height indicator according to one or more embodiments of the present invention.

Referring to FIG. 1, a patient transport cot 1 is provided comprising a height adjustment component coupled to the cot and configured to raise or lower the cot to a plurality of heights. The height adjustment component on the cot may comprise various mechanisms known to one skilled in the art. This may include, but is not limited to, pneumatic mechanisms, hydraulic mechanisms, electronic mechanisms, or the like. In one embodiment as shown in FIG. 1, the cot comprises an unpowered height adjustment component 60 wherein the height of the cot 1 is adjusted by mechanically or electrically raising or lowering the cot via a lifting bar 50. In a further embodiment, the lifting bar 50 may be utilized for raising or lowering the cot through a ratcheting mechanism. As such mechanisms are known, no further discussion is provided regarding component 60.

Figure 2:
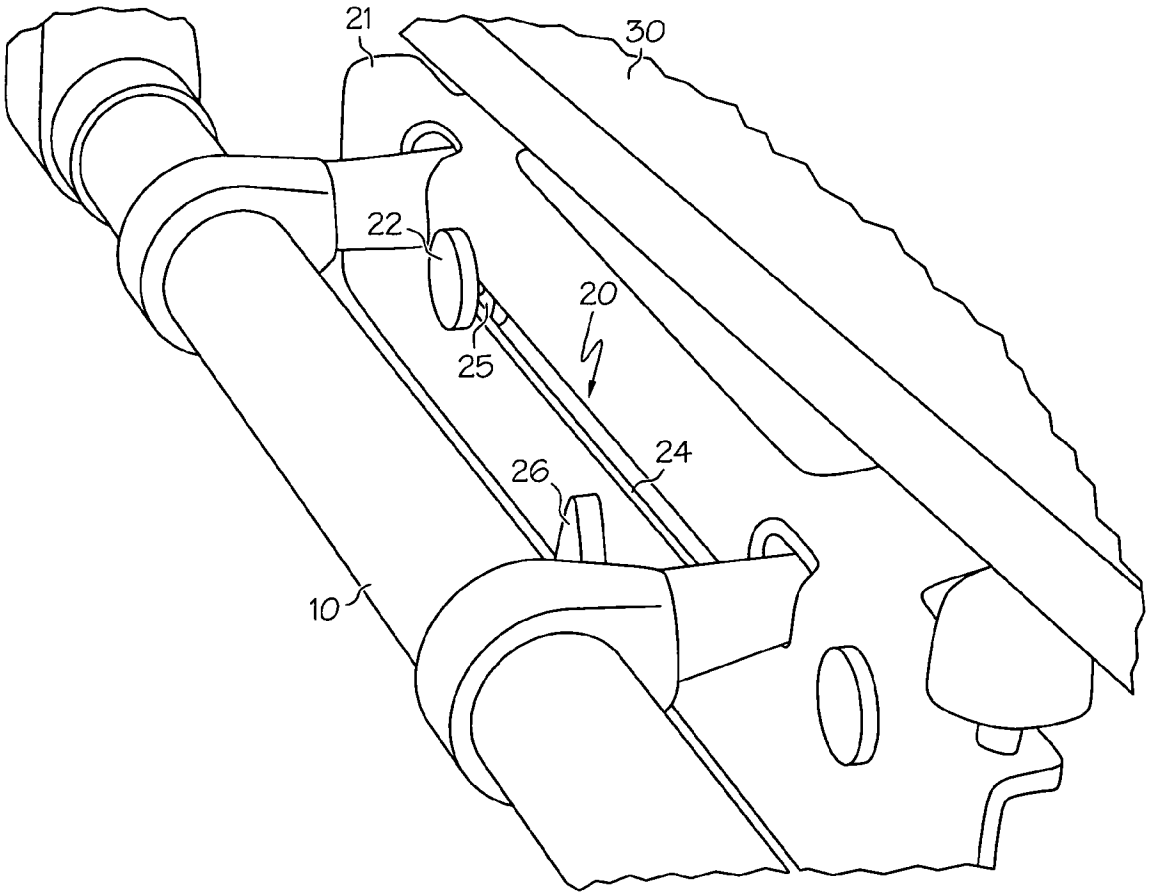
FIG. 2 is a schematic view of a mechanical height indicator according to one or more embodiments of the present invention.

Referring generally to FIGS. 1 and 2, the cot 1 further comprises a mechanical height indicator 20 coupled to the cot 1. A "mechanical indicator", as defined herein, refers to all height indicators that do not comprise an electrical power source, such as a battery. In the embodiment of FIGS. 1 and 2, the height indicator 20 is joined to a support rail 10 via a plate 21; however, other locations for the height indicator 20 are possible. The height indicator 20 comprises at least one height setting component, which may be stationary or adjustable. In the embodiment of FIG. 2, the height setting component comprises adjustable knobs 22 coupled to a slidable track 24 by metal backing 25, and movable along the slidable track 24. By sliding the knobs 22 along the track 24, the user is able to set multiple target heights. The knobs 22 may comprise a tightening mechanism, for example, a screw tightening mechanism for tightening the knob 22 against the plate 21. In addition to adjustable knobs, other height setting indicia may be provided on a visible surface e.g. a plate. For example, the indicia may include a plurality of tick marks, words, and/or numerical designations disposed on the plate 21. The multiple target heights may represent the proper height for aerial transport, ambulance transport, or any other height desired by the operator.

The height indicator 20 further comprises a moving height marker 26 configured to move with the cot 1 as the cot 1 is raised or lowered. As shown in the embodiment of FIG. 2, the marker 26 may comprise a moving arrow, or any other suitable marker known to one skilled in the art. In operation, the target cot height is achieved when the height marker 26 is aligned with the height setting 22. For example, the cot 1 is at the target cot height when the arrow 26 is aligned with the knob 22, or any other height setting indicia described above. "Aligned", as used herein, means horizontally, or vertically aligned as shown in FIG. 2. As shown in FIG. 2, the height indicator 20 comprises a plate 21 coupled to a support rail 10 and disposed at least partially vertically below the bed frame 30. As shown in FIG. 1, the bed frame 30 may comprise a mattress pad 40 overlying the frame 30 or a cover surrounding the frame 30.

Figure 3:
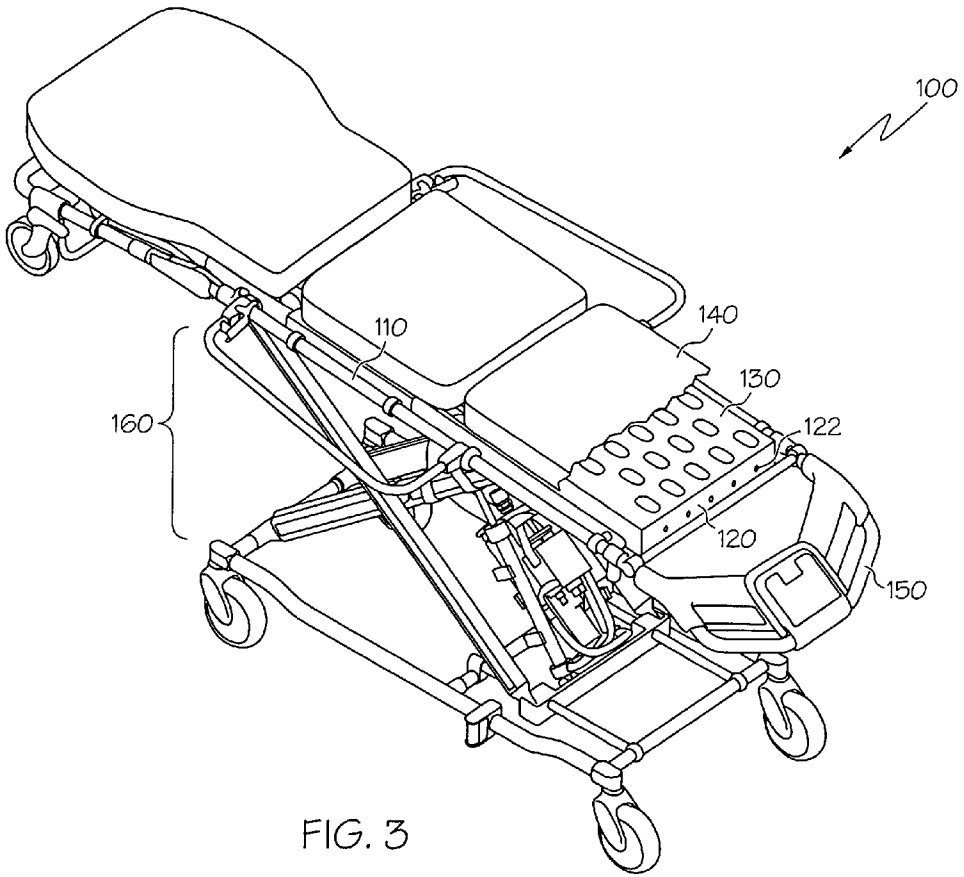
FIG. 3 is a schematic view of an ambulance cot comprising an electronic height indicator according to one or more embodiments of the present invention.

Referring to FIG. 3, a patient transport cot 100 comprising an electronic height indicator 120 is provided. Similar to above, the patient transport cot 100 comprises a height adjustment component 160 coupled to the patient transport cot 100, and configured to raise or lower the cot 100 to a plurality of heights. The height adjustment component 160 can comprise various mechanisms suitable for raising or lowering the cot to a plurality of heights, via a mechanical adjustment component 60 or an electrical adjustment component 160 as shown in FIG. 3. The electrical adjustment component 160 may, in one embodiment, be controlled by an electronic console 150 disposed at the foot of the cot.

Figure 4:
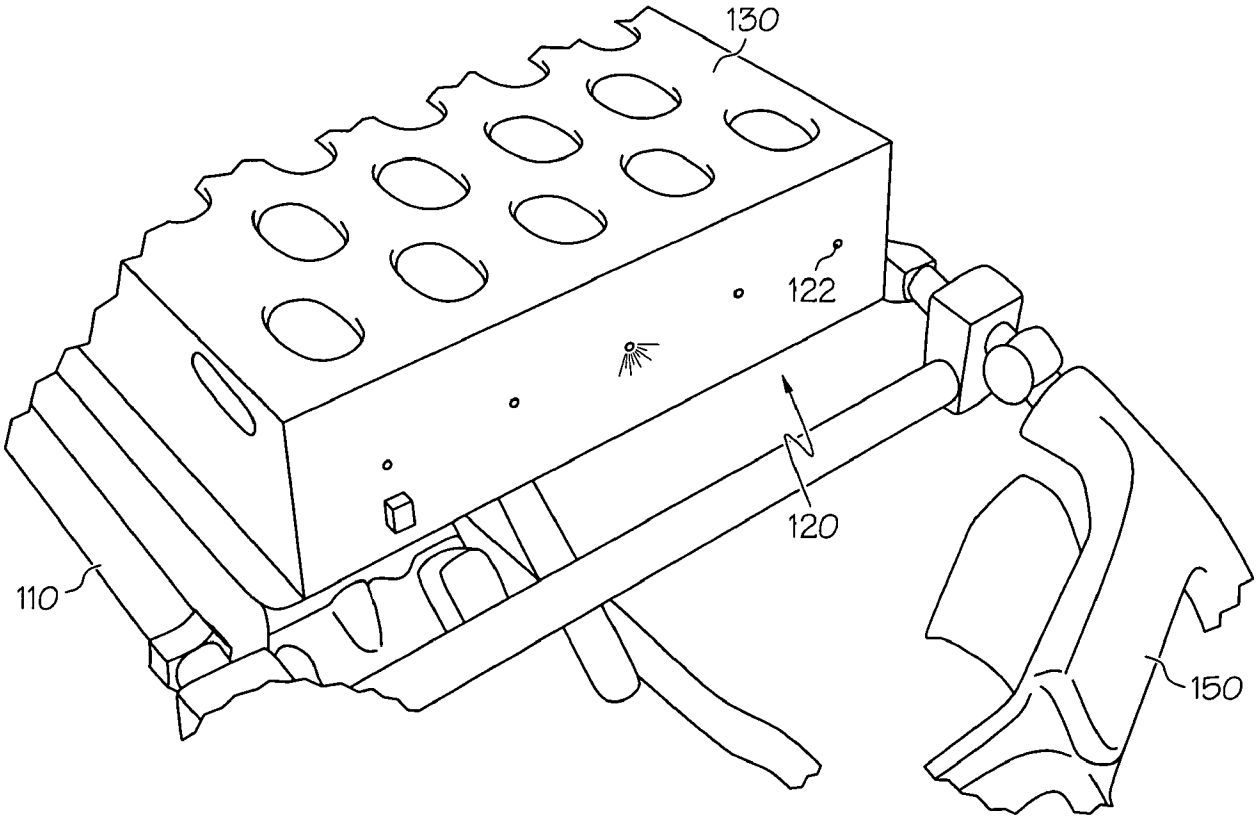
FIG. 4 is a schematic view of an electronic height indicator according to one or more embodiments of the present invention.
Figure 5:
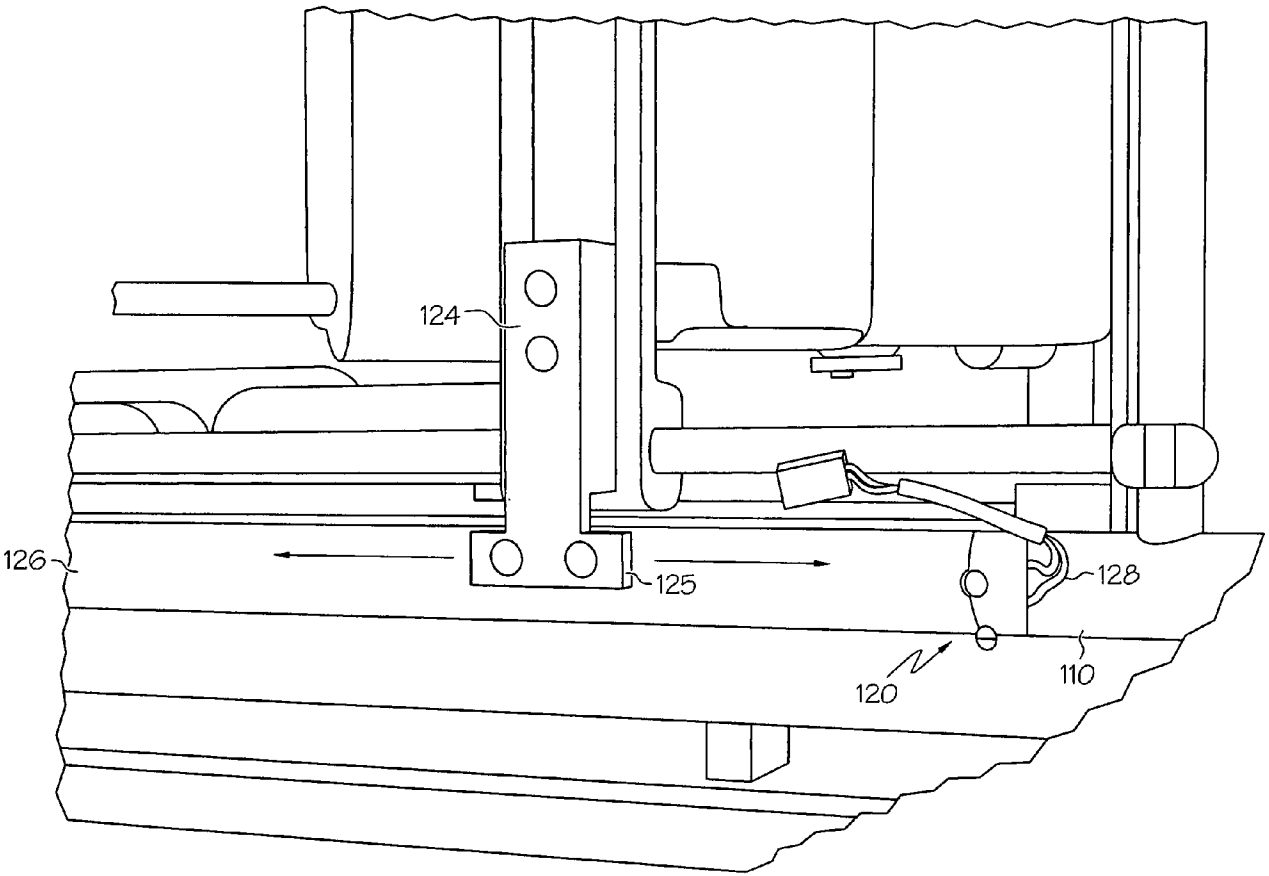
FIG. 5 is another schematic view of an electronic height indicator according to one or more embodiments of the present invention.

Referring generally to FIGS. 3-5, the patient transport 100 cot further comprises an electronic height indicator 120 coupled to the patient transport cot 100. The height indicator 120 comprises at least one height sensor (not shown), wherein each height sensor represents a target cot height. The height sensor may comprise any suitable electrical, or magnetic sensor known to one skilled in art. The sensors may include, but are not limited to, magnetically operated switches, proximity sensors, leaf switches, and combinations thereof. The patient transport cot 100 also comprises at least one visual display component 122 coupled to the height sensor. In operation, the height sensor is triggered when the cot 100 is adjusted to the target cot height setting represented by the height sensor. Triggering the height sensor actuates the visual display component 122.

In one embodiment as shown in FIG. 5, the height sensors may comprise magnetically operated switches embedded inside a flat strip 126 coupled to the support rail 110. The flat strip 126 may comprise any metal or rigid polymeric material known to one skilled in the art. In one embodiment, the metal comprises an acetal resin, for example, Delrin® produced by Dupont®. In a further embodiment as shown in FIG. 5, the patient transport cot 100 further comprises at least one magnet 125 disposed in a magnet holder 124. The magnet holder 124 is coupled to a moveable component of the cot 100, for example, any movable undercarriage component of the patient transport cot 100. As a result, the magnet 125 may move with the cot 100 as the cot 100 is raised or lowered. In an embodiment as shown in FIG. 5, the magnet 125 may slide along the flat strip 126, when the cot 100 is being adjusted. As the magnet 125 slides to within a set distance of the magnetically operated switches in the strip 126, the switches are moved to the "ON" position. Upon triggering the switches, a signal is sent to the visual display component 122, thereby actuating the visual display component 122. The signal may be transferred via any suitable transmission mechanism known to one skilled in art. For example, the signal may be transmitted to the visual component via wire 128 or wirelessly as well. The bed frame 130 may cover at least part of the wire 128. The bed frame 130 comprises any suitable metallic or polymeric material configured to provide support to a patient being transported on the patient cot 100. As shown in the embodiment of FIGS. 3 and 4, the bed frame 130 may comprise pieces of sheet metal comprising a plurality of holes. As shown in FIG. 3, the cot 100 may comprise a mattress pad 140 or cover overlying or surrounding the bed frame 130.

The visual display component 122 may comprise any suitable display means to notify the user of the cot height. In one embodiment, the visual display component 122 may comprise a digital readout configured to provide the height of the cot to the user in numerical, alphabetical, or alphanumeric format. For example, and not by way of limitation, the digital readout may display "12", "HIGH" or "HIGH 12" to indicate to the user that the cot is at the highest height setting. In another embodiment, the visual display component 122 may comprise at least one (LED) light emitting diode component 122. The LED components 122 may comprise a plurality of colors, with each color signifying a different target cot height. By illuminating and LED, the LED conveys that the cot has been adjusted to a target cot height. In addition to colors, the LED may display words, numbers, and the like that convey to the user a target cot height has been achieved. For example, if the cot was raised to the highest level, a colored LED could flash, or the word "HIGH" could be displayed by the visual display component 122. The height indicator 120 may comprise multiple LEDs, and thereby multiple target heights. The FIG. 4 embodiment shows an indicator 120 having 5 LEDs, which light up at specific heights as the cot 100 is adjusted from a full-down to full-up position. For example, and not by way of limitation, a red LED 122 may indicate a loading height wherein the cot 100 has the highest center of gravity and is most susceptible to tip-overs. As the cot is lowered, a green LED 122 may be utilized to indicate the first acceptable height for moving the loaded cot 100 onto the ground. A blue LED 122 may indicate that the surface is at the desired level position for neonatal transport. Another LED 122 may indicate an acceptable height for loading and unloading from a bed, a last LED may indicate the last acceptable transport height before the cot 100 must be lowered to full-down position in order to reduce stress on the cot 100, specifically the undercarriage and cross legs.

Both height indicators, the mechanical height indicator 20 and the electronic height indicator 120, may be incorporated into either manual cots 1, such as the 35-P® cot produced by Ferno Washington®, or electrically powered cots 100, such as the Powerflexx® cot produced by Ferno Washington®. The electronic height indicator 120 may comprise its own electric power source, for example, a battery such as a standard 9V DC battery. Alternatively, when incorporated onto an electric cot, the electric cot 100 may power the electronic height indicator 120. The height indicators 20, 120 may comprise rigid materials, for example, metals, rigid polymeric materials, or combinations thereof.

It is noted that terms like "specifically," "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A patient transport cot comprising:

a height adjustment component coupled to the patient transport cot and configured to raise or lower the cot to a plurality of heights;

a mechanical height indicator coupled to the patient transport cot comprising, at least one adjustable height setting component configured to set at least one target height for the cot; and a moving height marker configured to move with the cot as the cot is raised or lowered, wherein the cot is adjusted to the target cot height when the moving height marker is aligned with the height setting component.

2. A patient transport cot according to claim 1 wherein the height setting component comprises at least one adjustable knob disposed on a slidable track, wherein the target cot height is operable to be adjusted by sliding the adjustable knob to various locations along the track.

3. A patient transport cot according to claim 1 wherein the height adjustment component comprises a ratcheting device.

4. A patient transport cot according to claim 1 wherein the height adjustment component comprises an electrical adjustment component.

5. A patient transport cot according to claim 1 wherein the patient transport cot is an electric or manual cot.

6. A method for adjusting the height of a patient transport cot to a target height comprising:

providing a patient transport cot comprising, a height adjustment component coupled to the patient transport cot and configured to raise or lower the cot to a plurality of heights;

a mechanical height indicator coupled to the patient transport cot comprising, at least one adjustable height setting component configured to set at least one target height for the cot on the indicator; and a moving height marker configured to move with the cot as the cot is raised or lowered, adjusting the height of the patient transport cot by raising or lowering the cot until the moving height marker is aligned with the height setting component.

7. The method according to claim 6 wherein the height setting component comprises at least one adjustable knob disposed on a slidable track.

8. The method according to claim 7 further comprising setting the target cot height by sliding the adjustable knob to various locations along the track.

9. The method according to claim 6 wherein the height adjustment component comprises a ratcheting device.

10. The method according to claim 6 wherein the height adjustment component comprises an electrical adjustment component.

11. The method according to claim 6 wherein the patient transport cot is an electric or manual cot.

* * * * *